US005852909A

United States Patent [19]

Soltis et al.

[11] Patent Number: 5,852,909

[45] Date of Patent: Dec. 29, 1998

[54] LOCALIZED NOTCH REINFORCEMENT FOR WOODEN BEAMS

[75] Inventors: Lawrence A. Soltis, Mt. Horeb; Robert J. Ross; Douglas R. Rammer, both of Madison, all of Wis.

[73] Assignee: The United States of America as represented by the Secretary of Agriculture, Washington, D.C.

[21] Appl. No.: 943,367

[22] Filed: Oct. 3, 1997

Related U.S. Application Data

[60] Division of Ser. No. 749,604, Nov. 18, 1996, Pat. No. 5,720,143, which is a continuation-in-part of Ser. No. 576,998, Dec. 26, 1995, Pat. No. 5,575,117, which is a continuation-in-part of Ser. No. 204,114, Mar. 1, 1994, Pat. No. 5,501,054.

[51] Int. Cl.[6] ..... E04C 5/07

[52] U.S. Cl. ..... 52/730.7; 52/105; 52/309.15; 52/736.4; 52/737.5

[58] Field of Search ..... 52/105, 730.7, 52/736.4, 737.5, 309.15

*Primary Examiner*—Christopher Kent

*Attorney, Agent, or Firm*—Janet I. Stockhausen; M. Howard Silverstein; John D. Fado

[57] ABSTRACT

A localized fiber reinforcement places strong tensile strength fibers across a hypothetical split line near notches in beams to curtail split propagation caused by cross-grain tension that may otherwise significantly reduce the strength of a beam used as a spanning member. An adhesive coated patch may be applied after a notch is cut in the beam or fibers may be attached to a beam at a factory near the location of an anticipated notching.

3 Claims, 1 Drawing Sheet

FIG. 1
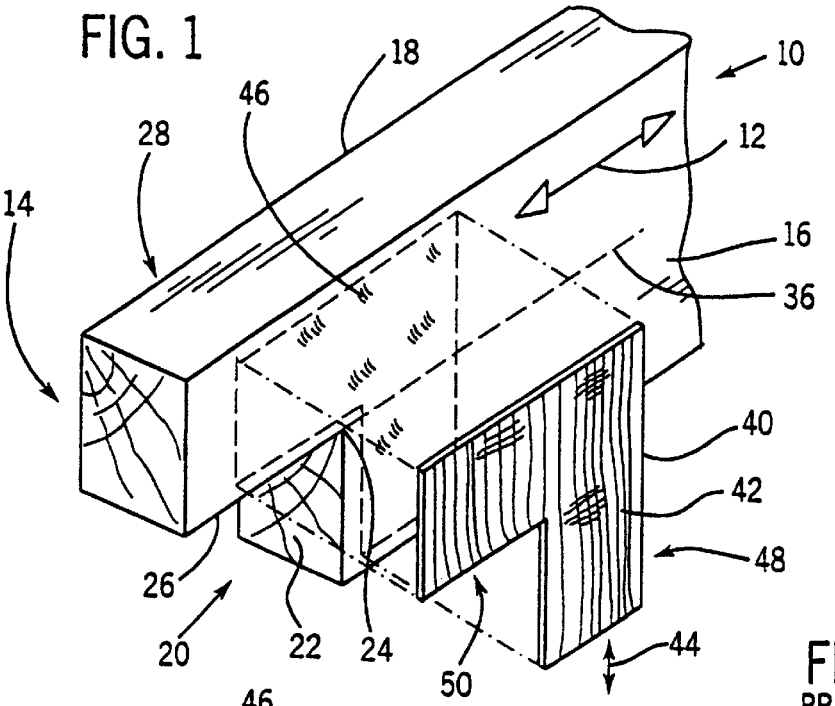
FIG. 2
PRIOR ART
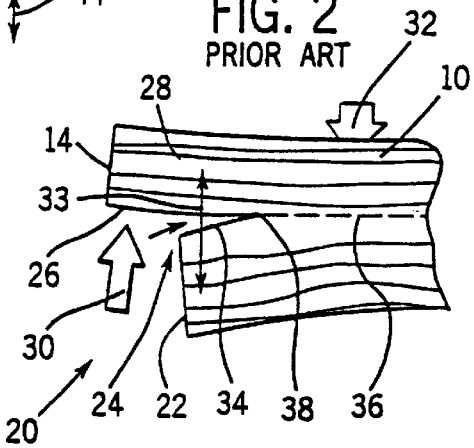
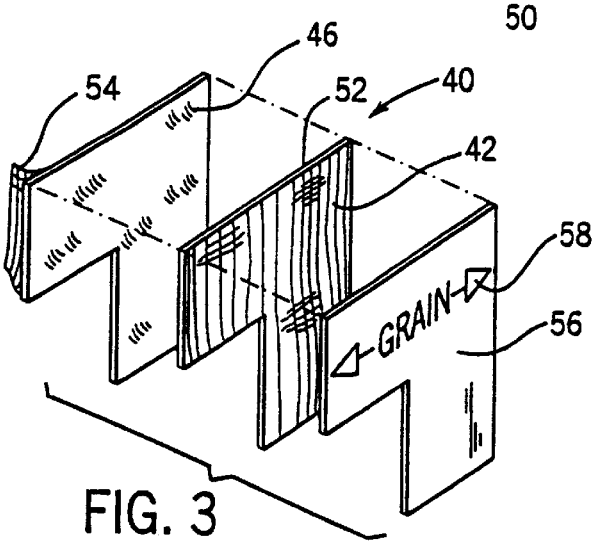
FIG. 3
FIG. 5
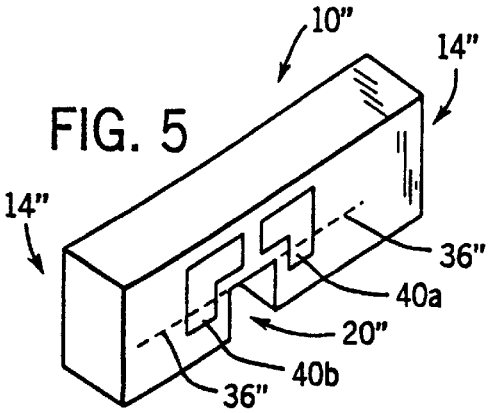
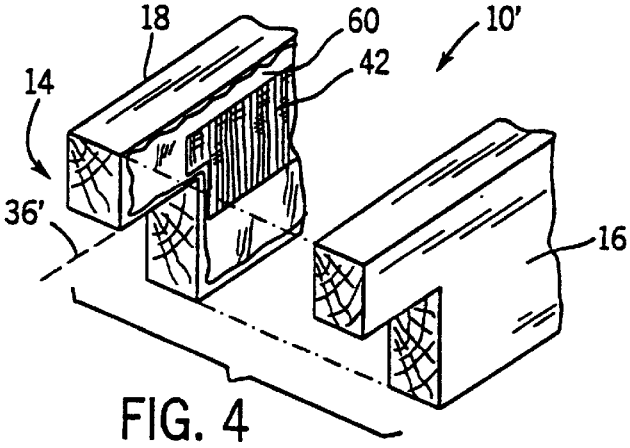
FIG. 4

LOCALIZED NOTCH REINFORCEMENT FOR WOODEN BEAMS

CROSS-REFERENCE TO RELATED APPLICATIONS

This application is a divisional of U.S. application Ser. No. 08/749,604, filed Nov. 18, 1996 now U.S. Pat. No. 5,720,143 which is a continuation in part of U.S. application Ser. No. 08/576,998 filed Dec. 26, 1995 now U.S. Pat. No. 5,575,119 which is a continuation in part of U.S. application Ser. No. 08/204,114 filed May 1, 1994 now U.S. Pat. No. 5,501,054.

STATEMENT REGARDING FEDERALLY SPONSORED RESEARCH OR DEVELOPMENT

BACKGROUND OF THE INVENTION

The invention relates generally to wooden structural members used in construction and more specifically to a reinforcement method for notched wooden beams.

Wooden beams may be used in construction to provide a horizontal span between walls or between walls and a central girder, for example as floor or ceiling joists. In such applications, the grain of the wood is aligned with the horizontal span.

Wood has relatively little strength perpendicular to the grain in comparison to its strength along the axis of its grain. For example, a sample of Douglas-fir might have parallel-to-grain tensile and compressive strengths of 15,600 and 3,470 PSI, respectively, but perpendicular-to-grain tensile and compressive strengths of only 360 and 340 PSI, respectively.

The strength of a wooden beam in a spanning application derives from the fact that the forces experienced by the beam when loaded are primarily oriented along the grain (tension, compression and shear) with essentially no cross-grain tension. This assumes, however, that the beam is supported underneath its ends and that the beam is of essentially uniform cross section without cuts or notches. This latter assumption may not always be true in practice. Beams may be cut or notched in various places to run utilities or to fit against other structural members. Notches that extend a significant distance into the beam may be an unavoidable part of the building's design or may occur from poor construction techniques.

Generally, a notch in a beam causes some of the loading of the beam to be manifest as cross grain tension, a mode in which wood is relatively weak. Additionally, the stress concentration at the notch re-entrant corner produces stresses to initiate and propagate a crack. As a result, if a spanning beam is to be notched, it is necessary to use reduced loading figures for that beam resulting in the need for larger or more beams than would otherwise be necessary. In renovation projects, where beam number and size is fixed, notching of the beams may not be allowable.

BRIEF SUMMARY OF THE INVENTION

The present inventors have recognized that the loss of strength caused by the notching of spanning beams and the like results not only by the lower strength of wood across its grain, but also because of the dynamics of crack propagation where cross grain tensile stresses are concentrated at the apex of an advancing crack. This concentration of tensile stress significantly decreases the effective strength of the beam in what is already its weakest mode.

Accordingly, the present invention provides localized high tensile reinforcement across the grain of the beam and spanning a line of anticipated crack propagation. By blocking crack propagation, the strength of a notched beam is significantly increased. Further, the need for extensive reinforcement of the entire beam is avoided.

Specifically, the present invention provides a structural member formed of a wooden beam having a grain directed along the length of the beam between ends and across a width of the beam between edges, the length and width defining an area of opposing beam faces. The beam is notched and the notch has a first cut starting at an edge and crossing the grain and extending less than the width of the beam and second cut abutting the first cut at a corner. A tensile reinforcing material is bonded to at least one opposing face across a hypothetical split line starting at the corner and extending parallel to the grain where an axis of tensile strength of the reinforcing material is directed across the grain.

Thus, it is one object of the invention to provide a reinforcement technique that addresses the mechanism of crack propagation through lumber at notches in the lumber. A limited amount of reinforcement near the notch can increase the strength of notched lumber for cross grain loads over its entire length by stopping crack propagation.

It is another object of the invention to provide a substantial increase in the effective load carrying capacity of beams without the need for extensive reinforcement of the entire beam.

A second beam, substantially equal in length and width to the first beam, may be bonded to the first beam to sandwich the tensile reinforcing material between the beam and the one face.

Thus, it is another object of the invention to provide a reinforcement for a notch centered within the likely path of crack propagation.

In one embodiment, the flexible fiber reinforcing material is a patch having fibers running along an axis. An adhesive is applied to one side of the patch and indicia is attached to the patch indicating a desired alignment of the patch with wood grain. The flexible fiber patch may be applied to a wooden beam with the axis perpendicular to the grain of a wooden beam.

Thus it is another object of the invention to provide a reinforcement method which may be used on site when notching of beams is necessary. The indicia is used to properly align the patch and the adhesive to attach the patch to the beam after the notch has been cut.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

BRIEF DESCRIPTION OF THE SEVERAL VIEWS OF THE DRAWINGS

FIG. 1 is a fragmentary, perspective view of a notched wooden beam showing a projected split line extending from a corner of the notch and showing placement of localized reinforcement per the present invention to span this split line;

FIG. 2 is a simplified elevational view of the beam of FIG. 1 without localized reinforcement showing propagation of a crack along the split line with beam loading;

FIG. 3 is an exploded perspective view of a reinforcement according to the present invention and suitable for application in the field;

FIG. 4 is a fragmentary perspective view of a beam similar to that of FIG. 1 having pre-positioned internal reinforcement along an anticipated spit line; and FIG. 5 is a perspective view of second beam, similar to that of FIGS. 1, 2 and 4 but having an internal notch.

DETAILED DESCRIPTION OF THE INVENTION

Referring now to FIG. 1, a wooden beam 10, terminating at a first end 14, has grain 12 running along its length. The wooden beam 10 has generally rectangular cross section taken an perpendicular to the grain 12 and presents generally parallel first and second opposed faces 16 and 18, respectively. Faces 16 and 18 have lengths commensurate with the length of the beam 10 and heights commensurate with the width of the beam 10. In use, the wooden beam 10 may be positioned with faces 16 and 18 oriented in vertical planes and with the length of the wooden beam 10 extending horizontally.

A notch 20 is cut in the first end 14 starting at a lower edge and is characterized by having a first cut 22 cutting across the grain 12 to a corner 24 within the wooden beam 10. At the corner 24, the first cut 22 meets with a second cut 26, the latter which extends along the grain 12 from the corner 24 toward the first end 14. The first cut 22 extends less than the width of the beam 10 so that the notch 20 provides an overhang portion 28 at near end 14 of the beam 10 such as may rest against a sill plate or the like.

Referring now to FIG. 2, when beam 10 is positioned with the overhang portion 28 resting on top of a support surface 30 (shown schematically as an upward arrow), downward loading on the beam 10 (shown by arrow 32) creates a tensile force (shown by arrow 33) on the material of the beam at the corner 24. The notch 20 causes this tensile force 33 to concentrate at the corner 24 promoting a split 34. The split 34 travels along a split line 36 extending parallel to the grain 12 of the beam 10 and thus along the length of the beam 10.

As the split 34 progresses, its apex 38 continues to define a point of concentrated tensile stress permitting the split 34 to expand further even though the total tensile forces 33, if distributed evenly over the length of the beam would be insufficient to separate the grain 12 of the beam 10.

Referring again to FIG. 1, present invention recognizes that localized reinforcement of the beam 10 crossing the split line 36 can substantially increase the working load of a notched beam 10 in spanning applications. In particular, an inverted L-shaped reinforcement patch 40 having a plurality of fiberglass fibers 42 extending along a fiber axis 44, is attached to one face 16 of the beam 10 by means of an epoxy adhesive 46 applied to the face 16. The L-shape of the patch 40 allows it follow the first and second cuts 22 and 26 of the notch 20.

In particular, a vertical, generally rectangular portion 48 of the patch 40 extends somewhat less than the height of the beam 10 to have a lower extent adjacent to the first cut 22 on the face 16 and an upper extent spanning the split line 36. The fibers 42 and fiber axis 44 are arranged vertically in this portion 48 to cross the grain 12 and the split line 36.

A second portion 50 of patch 40 extends from the upper extent of the first portion 48 along the direction of the grain 12 onto the overhang portion 28. The fibers 42 and fiber axis 44 in this portion 50 are also are arranged vertically to cross the grain 12.

The first portion 48 of the patch 40 serves to check any progress of a crack along the split line 36. The second portion 50 serves primarily as an alignment guide for the patch 40, but also increases the strength of the overhang portion 28 against cross grain and shear forces.

A similar patch 40 may be applied to the opposite face 18 of the wooden beam 10 to oppose the first patch 40 and to provide yet further reinforcement. For pre-manufactured beams 10, these patches 40 may be applied at a factory site.

In an alternative embodiment, the patch 40 shown in FIG. 3 may be adapted to field installation. In this case, the fibers 42 may be attached to a carrier 52 such as a polyester film or the like. An adhesive 46 may then be applied on the opposite side of the carrier 52 and may include a removable backing 54 to expose the adhesive 46 prior to placement of the patch 40 on the beam 10. The adhesive may be an epoxy such as those advertised under the tradename WEST SYSTEM such as is commercially available from Gougeon Brothers, Inc. of Bay City, Mich. A cover sheet 56 may then be placed over the fibers 42 on the side opposite the adhesive 46 to provide indicia 58 indicating proper alignment of patch 40 with the grain of beam 10. In a preferred embodiment, the indicia provides a printed arrow indicating the grain direction in the beam 10 when the patch 40 is properly affixed to the beam 10.

Such a patch 40 may be used on the work site when it is necessary to notch a beam 10 for utilities and the like. When the notch 20 is positioned in the middle of the beam multiple patches 40 may be used on each face 16 and 18 to flank the notch 20 and thus, it may be desirable to produce a right and left handed version of the patch 40 with the placement of the cover sheet 56 and the adhesive 46 reversed in the two versions.

Referring now to FIG. 4, a prefabricated notchable beam 10' may be constructed by ripping a normal beam 10 along its length midway between faces 16 and 18 to separate the beam 10' into two parts. Fibers 42 may be glued with an adhesive 60 to the cut face of one half of the beam 10' across an anticipated split line 36' near the ends 14 of the beam 10'. The fibers may be laid solely cross grain. The same adhesive 58 is then used to join the halves of the beam 10' together again about the fibers 42 to hold and stabilize the fibers 42.

Because the exact location of the notch may not be known in advance, the fibers 42 may be placed to extend along the middle one-third of the width of the beam for the last several feet of the beam 10' at each end or other locations to accommodate reasonably expected notching operations as the beam ends. The fiberglass fibers 42 as embedded in the beam 10' may be readily cut with ordinary wood saws.

Referring now to FIG. 5, the present invention is also applicable in a beam 10" where the notch 20" is placed between ends 14" where the cuts of the notch start and end at an edge of the beam 10". Here the left and right hand versions of the patch 40 (indicated as 40*a* and 40*b*) may be used to reinforce the split lines 36" extending in two directions from the notch 20" along the line of the grain 12.

The above description has been that of a preferred embodiment of the present invention it will occur to those that practice the art that many modifications may be made without departing from the spirit and scope of the invention.

In order to apprise the public of the various embodiments that may fall within the scope of the invention, the following claims are made:

We claim:

1. A field-ready wood beam reinforcement system comprising:

a flexible fiber patch having at least some fibers running along an axis;

an adhesive applied to one side of the patch;

indicia attached to the patch indicating a desired alignment of the patch with wood grain;

wherein the flexible fiber patch may be applied to a wooden beam with the axis crossing the grain of the wooden beam.

2. The field-ready wood beam reinforcement system of claim 1 wherein the patch is "L" shaped to fit adjacent to a notch in the wooden beam.

3. The field-ready wood beam reinforcement system of claim 1 wherein the fibers are fiberglass.

* * * * *